US009214296B2

(12) United States Patent
Sago

(10) Patent No.: US 9,214,296 B2
(45) Date of Patent: Dec. 15, 2015

(54) WATERPROOF STRUCTURE AND SWITCH DEVICE INCLUDING WATERPROOF STRUCTURE

(71) Applicant: ALPS ELECTRIC CO., LTD., Tokyo (JP)

(72) Inventor: Tetsuya Sago, Tokyo (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 108 days.

(21) Appl. No.: 14/107,493

(22) Filed: Dec. 16, 2013

(65) Prior Publication Data

US 2014/0291131 A1 Oct. 2, 2014

(30) Foreign Application Priority Data

Mar. 29, 2013 (JP) ..... 2013-071292

(51) Int. Cl.
*H01H 13/06* (2006.01)
*H01H 9/04* (2006.01)

(52) U.S. Cl.
CPC *H01H 9/04* (2013.01); *H01H 13/06* (2013.01)

(58) Field of Classification Search
CPC ..... H01H 13/06; H01H 9/04
USPC ..... 200/302.2, 302.1
See application file for complete search history.

(56) References Cited

U.S. PATENT DOCUMENTS

| | | | | |
|---|---|---|---|---|
| 7,705,255 | B2 * | 4/2010 | Yokote | 200/302.2 |
| 7,764,936 | B2 * | 7/2010 | Nakasono et al. | 455/128 |
| 7,990,731 | B2 * | 8/2011 | Guo et al. | 361/753 |
| 2010/0254124 | A1 * | 10/2010 | Bayat et al. | 362/206 |
| 2012/0140457 | A1 * | 6/2012 | McQuade | 362/184 |
| 2012/0199661 | A1 | 8/2012 | Hara et al. | |

* cited by examiner

*Primary Examiner* — Edwin A. Leon
*Assistant Examiner* — Ahmed Saeed
(74) *Attorney, Agent, or Firm* — Brinks Gilson & Lione

(57) ABSTRACT

An engine start switch includes a substrate on which electronic components are mounted, a case which is formed in a cylindrical shape by a peripheral wall portion surrounding the substrate and of which at least one end portion is opened, and a support member that supports the substrate in the case and extends toward the open end of the case from one end portion thereof supporting the substrate. The support member includes an outer surface that faces an inner surface of the peripheral wall portion with a gap interposed therebetween, and a gap at the one end portion of the support member is wider than a gap at other portions excluding at least the one end of the support member.

3 Claims, 6 Drawing Sheets

WATERPROOF STRUCTURE AND SWITCH DEVICE INCLUDING WATERPROOF STRUCTURE

CLAIM OF PRIORITY

This application claims benefit of Japanese Patent Application No. 2013-071292 filed on Mar. 29, 2013, which is hereby incorporated by reference.

BACKGROUND OF THE INVENTION

1. Field of the Invention

The present invention relates to a waterproof structure, which can be applied to an engine start switch, and a switch device.

2. Description of the Related Art

An in-vehicle switch device such as an engine start switch, which illuminates an operation surface of an operation button by the pressing operation of the operation button, is known (for example, see Japanese Unexamined Patent Application Publication No. 2011-124030). An operation button is slidably received in a cylindrical case of the switch device so that an operation surface is exposed to the outside, and a substrate provided with a light-emitting element such as an LED is received on the inner side of the operation button. A rubber contact is mounted on the substrate. When the rubber contact is pressed against the operation button, the light-emitting element emits light. In this way, the operation surface of the operation button is illuminated from the inside of the case by the light-emitting element mounted on the substrate.

Incidentally, the switch device disclosed in Japanese Unexamined Patent Application Publication No. 2011-124030 is provided with a support member that supports the substrate in the case. The support member has an outer surface that faces the inner surface of the case with a small gap interposed therebetween. For this reason, when water droplets adhere to the back side of the switch device due to dew condensation or the like, there is a concern that the water droplets infiltrate into the case through a gap between the inner surface of the case and the outer surface of the support member due to capillary phenomenon and cause the corrosion of electronic components mounted on the substrate.

Meanwhile, a structure, which prevents the infiltration of water droplets into the case by making temperature inside the case be close to temperature outside the case to suppress the negative pressure in the case, is also considered, but there is a problem in that the number of parts or man-hour is increased and the size of a device or the manufacturing cost is increased. Further, there are concerns that the internal pressure is increased due to the rise of internal temperature caused by a heat-generating component present in the case and abnormality occurs.

SUMMARY OF THE INVENTION

The invention provides a waterproof structure that can prevent water droplets from infiltrating into a case with a simple and inexpensive structure and a switch device including the waterproof structure.

According to an aspect of the invention, there is provided a waterproof structure including: a substrate on which electronic components are mounted; a case which is formed in a cylindrical shape by a peripheral wall portion surrounding the substrate and of which at least one end portion is opened; and a support member that supports the substrate in the case and extends toward the open end of the case from one end portion thereof supporting the substrate. The support member includes an outer surface that faces an inner surface of the peripheral wall portion with a gap interposed therebetween, and a gap at the one end portion of the support member is wider than a gap at the other portions excluding at least the one end of the support member.

According to this structure, even though water droplets infiltrate into a gap between the inner surface of the peripheral wall portion and the outer surface of the support member due to capillary phenomenon, a suction force for the water droplets is weakened since the gap between the inner surface of the peripheral wall portion and the outer surface of the support member is widened at one end portion of the support member that supports the substrate. For this reason, it is possible to prevent the movement of the water droplets toward the substrate, so that the electronic components mounted on the substrate are not corroded. Further, it is possible to obtain a waterproof structure that is simple and inexpensive.

Furthermore, in the waterproof structure according to the aspect of the invention, the support member may include a support main body that faces the peripheral wall portion over the entire circumference at the other portions except for the one end and a plurality of protrusions that partially face the peripheral wall portion at the one end, and a plurality of points of the substrate may be supported by the plurality of protrusions. According to this structure, since the area of the support main body facing the inner surface of the peripheral wall portion is larger than the area of the protrusion facing the inner surface of the peripheral wall portion, a force for holding water droplets is increased at the gap between the inner surface of the peripheral wall portion and the outer surface of the support main body. For this reason, it is possible to effectively prevent the movement of water droplets toward the substrate. Moreover, since the substrate is supported at the plurality of points by the plurality of protrusions, rattling or an error at the time of assembly can be absorbed even though warpage or distortion occurs on the substrate.

Further, in the waterproof structure according to the aspect of the invention, the plurality of protrusions may be formed thin so that a gap between the inner surface of the peripheral wall portion and an outer surface of each of the plurality of protrusions is wider than a gap between the inner surface of the peripheral wall portion and the outer surface of the support main body. According to this structure, since the gap between the inner surface of the peripheral wall portion and the outer surface of the protrusion is widened, it is possible to effectively prevent the movement of water droplets toward the substrate by weakening a suction force for water droplets, which is caused by capillary phenomenon, in front of the substrate.

Furthermore, in the waterproof structure according to the aspect of the invention, the gap between the inner surface of the peripheral wall portion and the outer surface of each of the plurality of protrusions may be in the range of 0.55 mm to 0.75 mm, and the gap between the inner surface of the peripheral wall portion and the outer surface of the support main body may be in the range of 0.15 mm to 0.35 mm. According to this structure, it is possible to more effectively prevent the movement of water droplets toward the substrate that is caused by capillary phenomenon, and it is possible to appropriately fit the support member to the case while ensuring the assemblability between the case and the support member.

Moreover, the waterproof structure according to the aspect of the invention may be applied to a switch device. According to this structure, it is possible to prevent the corrosion of electronic components mounted on the substrate that is caused by the infiltration of water droplets, and to prevent the malfunction or breakdown of the switch device that is caused by the infiltration of water droplets. Further, since it is possible to prevent the infiltration of water droplets into the substrate with a simple structure, it is possible to provide an inexpensive switch device.

According to the invention, since a gap between an inner surface of a peripheral wall portion and an outer surface of a support member at one end portion of the support member is made wider than the gap at other portions excluding at least the one end of the support member, it is possible to prevent the infiltration of water droplets into the case using a simple and inexpensive structure.

DESCRIPTION OF THE PREFERRED EMBODIMENTS

Figure 1:
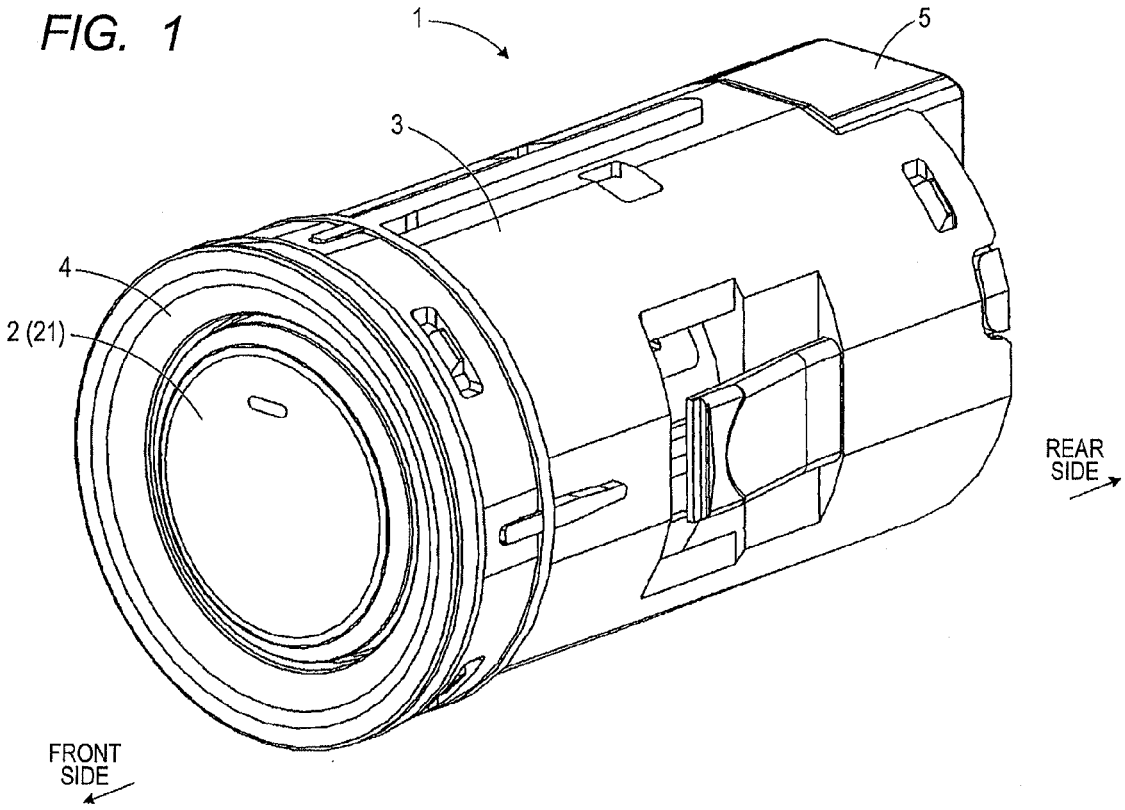
FIG. 1 is a perspective view of an engine start switch according to an embodiment.
Figure 2A:
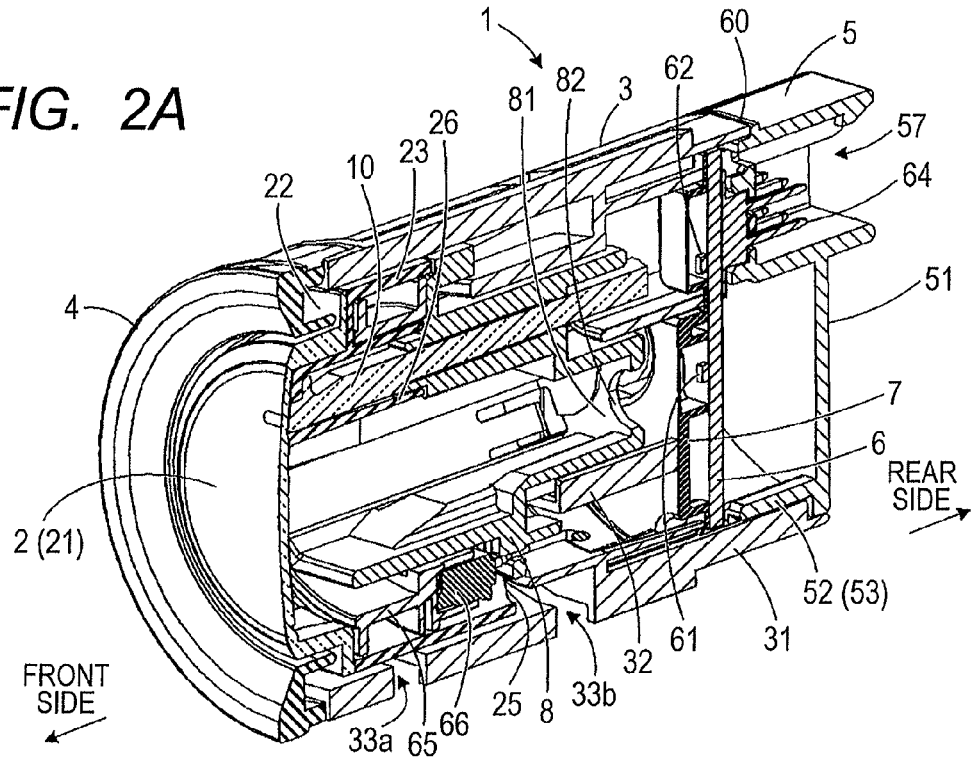
FIGS. 2A and 2B are cross-sectional perspective views of the engine start switch according to this embodiment.
Figure 2B:
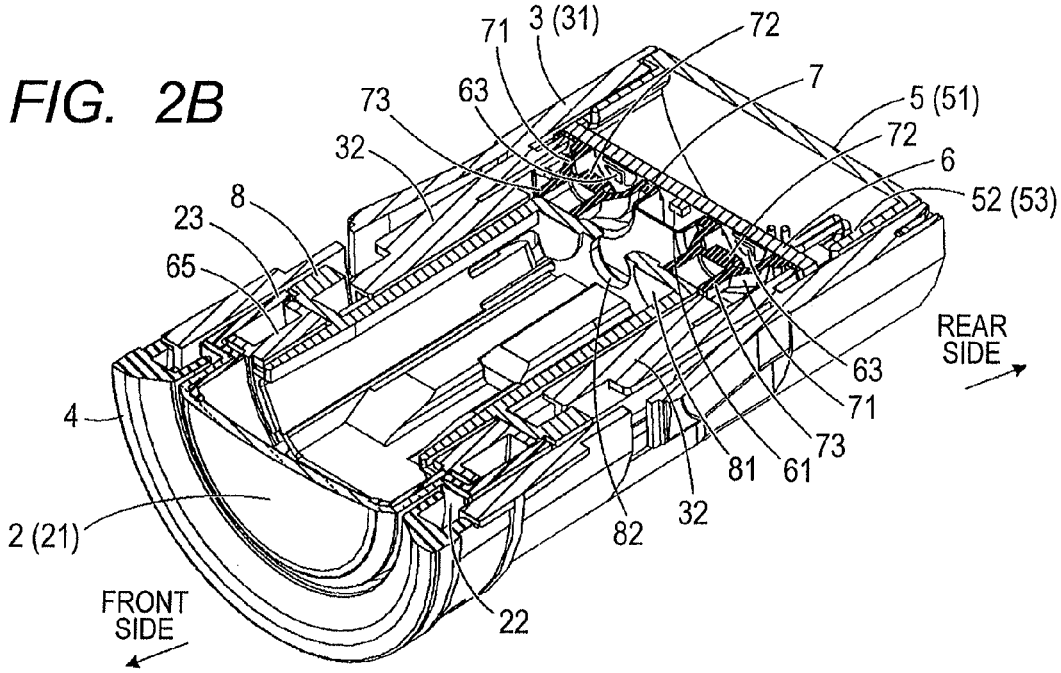

An embodiment will be described below with reference to FIGS. 1, 2A, and 2B. FIG. 1 is a perspective view of an engine start switch according to this embodiment. FIGS. 2A and 2B are cross-sectional perspective views of the engine start switch according to this embodiment. FIG. 2A is a cross-sectional perspective view of the engine start switch of FIG. 1 taken along a vertical plane, and FIG. 2B is a cross-sectional perspective view of the engine start switch of FIG. 1 taken along a horizontal plane. Meanwhile, an example in which a waterproof structure and a drain structure are applied to an engine start switch will be described in this embodiment, but the invention is not limited thereto. The waterproof structure and the drain structure according to this embodiment can be applied to an electronic device that prevents the infiltration of water droplets, and also can be applied to other switch devices such as a slide switch. Further, in FIGS. 2A and 2B, a coil antenna is simply referred to as an antenna for convenience.

As shown in FIGS. 1, 2A and 2B, an engine start switch 1 is adapted to be mounted on a dashboard of an automobile or the like and to control the ON/OFF of the engine by the pressing operation of an operation member 2. The operation member 2 of the engine start switch 1 is received in a case 3, and an operation surface 21 of the operation member 2 is exposed to the outside from the case 3. A ring-shaped exterior member 4, which surrounds the outer periphery of the operation surface 21, is provided at the front end of the case 3. A rear cover 5, which covers an open end of the case 3, is provided at the rear end of the case 3. A substrate 6 on which LEDs 61 and 62 are disposed is received in the case 3, and the substrate 6 is supported from the rear side by the rear cover 5. A rubber contact 7, which controls the ON/OFF of the engine start switch 1, is placed on the surface of the substrate 6.

Since a cylindrical slider 8 is fixed to the operation member 2, the operation member 2 and the slider 8 can slide in the case 3 as a single body. The slider 8 extends toward the substrate 6, and a rear end portion of the slider 8 comes into contact with the rubber contact 7. A coil antenna 65 for radio communication is provided at the front portion of the slider 8 so as to surround the outer periphery of the slider 8. A light plate 10, which transmits light to a predetermined point of the operation surface 21, is provided along the extension direction of the slider 8 at the upper portion of the slider 8. Further, the inner space of the case 3 is partitioned into a plurality of spaces by the respective members, and a connector 66 connecting the coil antenna 65 with the substrate 6 is provided in a space formed below the slider 8.

The case 3 is made of a synthetic resin, such as polyacetal, ABS (acrylonitrile butadiene styrene), or nylon (registered trademark) and have a cylindrical shape. The case 3 includes an outer peripheral wall portion 31 that forms a receiving space for the substrate 6 and the respective members and an inner wall portion 32 that partitions the receiving space. Further, the outer peripheral wall portion 31 is provided with a pair of drain ports 33*a* and 33*b* through which water droplets present in the switch are discharged to the outside. The engine start switch 1 is mounted on the dashboard so that the drain ports 33*a* and 33*b* are directed downward. Accordingly, water droplets present in the case 3 are directed to the drain ports 33*a* and 33*b* due to their own weight.

The operation member 2 is made of a translucent material and is formed in a bottomed cylindrical shape so that the operation surface 21 forms a bottom. The operation member 2 is received in the case 3 so that the operation surface 21 protrudes forward. The operation member 2 is illuminated by the LEDs 61 and 62 that are disposed on the substrate 6. Furthermore, a flange 22 is formed on the peripheral wall portion of the operation member 2, and the flange 22 is provided with a cylindrical portion 23 that covers the periphery of the coil antenna 65. A notch 25 is formed at the cylindrical portion 23 near the drain port 33*b* of the case 3. Although described below in detail, the notch 25 is formed so that the area of the cylindrical portion 23 facing the outer peripheral wall portion 31 of the case 3 is gradually reduced toward the drain port 33*b* of the case 3 and water droplets are easily discharged from the drain port 33*b*. The flange 22 of the operation member 2 is covered with the exterior member 4. Moreover, an inner wall portion 26 is provided in the operation member 2 so that the light of LED 61 and the light of LED 62 do not interfere with each other.

The slider 8 fixed to the operation member 2, and is formed in a substantially cylindrical shape. The slider 8 is disposed within the inner wall portion 32 of the case 3, and is guided in a longitudinal direction by the inner wall portion 32. Since the slider 8 is guided by the inner wall portion 32, the smooth pressing operation of the operation member 2 fixed to the slider 8 is allowed. Further, the rear end portion of the slider 8 forms a pressing portion 81 that presses the rubber contact 7. The pressing portion 81 comes into contact with the tips of dome portions 71 of the rubber contact 7, and a hole 82 is formed at the center of the pressing portion 81 so that light emitted from the LED 61 passes through the hole 82. Furthermore, fine ruggedness is formed on the inner surfaces of the operation member 2 and the slider 8. The fine ruggedness diffuses light emitted from the LED 61 and reduces the luminance unevenness of the operation surface 21.

The rear cover 5 not only functions as a cover covering the rear open end of the case 3 but also functions as a support member supporting the substrate 6. The rear cover 5 is made of a synthetic resin, such as polyacetal, ABS, or nylon. The rear cover 5 includes a bottomed cylindrical support main body 53 in which a peripheral wall portion 52 stands up from a bottom wall 51 serving as a rear end, and a plurality of protrusions 54 (see FIG. 3) that protrude from the front end of the peripheral wall portion 52. The rear cover 5 is assembled with the case 3 from the rear side of the case 3, and supports the outer peripheral portion of the substrate 6 in the case 3. That is, the rear cover 5 extends toward the open end of the case 3 from one end portion thereof that supports the substrate 6. Since the substrate 6 is supported at a plurality of points by the plurality of protrusions 54, rattling or an error at the time of assembly, which occurs on the substrate 6 due to warpage or distortion, is absorbed.

Further, when the rear cover 5 is to be assembled, the rear cover 5 is fitted into the case 3 with a predetermined gap interposed therebetween. This predetermined gap is designed so that the rear cover 5 can be smoothly inserted into the case 3 and does not rattle in the case 3. Accordingly, it is possible to appropriately fit the rear cover 5 to the case 3 while ensuring the assemblability of the case 3 and the rear cover 5. Since a gap is formed between the case 3 and the rear cover 5 at the open end of the case 3 as described above, a waterproof structure is provided so as to hinder the infiltration of water droplets from the rear end of the case 3.

Figure 4A:
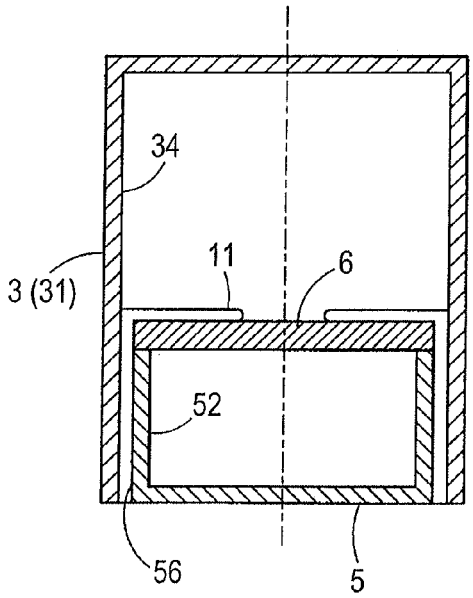
FIGS. 4A to 4D are views used to illustrate a waterproof structure according to this embodiment.
Figure 4B:
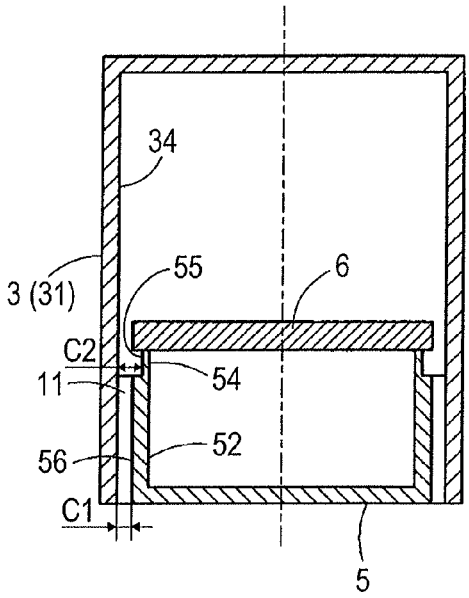

In this case, as a waterproof structure for the rear cover 5, the thickness of the protrusion 54 is smaller than the thickness of the peripheral wall portion 52 (see FIG. 4B). For this reason, the gap between the inner surface of the case 3 and the outer surface of the rear cover 5 is wider at the protrusion 54 than at the support main body 53. Each of the plurality of protrusions 54 weakens a suction force, which is caused by capillary phenomenon, by making the gap between the inner surface of the case 3 and itself large. Accordingly, water droplets, which infiltrate into the gap between the inner surface of the case 3 and the outer surface of the rear cover 5, are held in front of the substrate 6 so as not to move to the substrate 6.

A socket portion 57, which is connected with an external connector (not shown), is formed on the bottom wall 51 of the rear cover 5. As the waterproof structure for the rear cover 5, a waterproof wall 60, which prevents the infiltration of water droplets, is provided on the outer surface of the socket portion 57. The outer peripheral wall portion 31 of the case 3 is notched along the socket portion 57, and a small gap is formed between the rear end portion of the outer peripheral wall portion 31 of the case 3 and the waterproof wall 60 of the rear cover 5 at this notched portion (see FIG. 4D). For this reason, even though relatively large-sized water droplets adhere to the outer surface of the socket portion 57, the water droplets do not infiltrate into the case 3. Meanwhile, the detail of the waterproof structure according to this embodiment will be described below.

The substrate 6 is made of an insulating resin or the like so as to substantially have a disc shape. Various electronic circuits (not shown) or a pair of stationary contacts 63 are formed on the surface of the substrate 6. Further, the LEDs 61 and 62, which illuminate the operation surface 21, are mounted on the surface of the substrate 6 at the center of the substrate 6 and a position corresponding to the light plate 10. The rubber contact 7, which turns on and off the engine start switch 1, is placed on the surface of the substrate 6. Furthermore, a plurality of connecting pins 64 are provided on the back of the substrate 6 at positions corresponding to pin holes 58 (see FIG. 3) that are formed at the socket portion 57 of the rear cover 5.

The rubber contact 7 is made of a translucent soft elastic material so as to have a circular shape in plan view. A pair of dome portions 71 are formed on the rubber contact 7 at positions corresponding to the pair of stationary contacts 63 that are formed on the substrate 6. Movable contacts 72, which can come into contact with the stationary contacts 63 of the substrate 6, are provided on the backs of the dome portions 71.

Annular support portions 73 protrude toward the operation surface 21 from the centers of the pair of dome portions 71. The pressing portion 81 of the slider 8 comes into contact with the annular support portions 73 of the pair of dome portions 71. When the operation member 2 is pressed, the annular support portions 73 are pressed by the pressing portion 81 of the slider 8. The dome portions 71 receive a pressing force and are deformed, and the movable contacts 72 come into contact with the stationary contacts 63 of the substrate 6, so that the ON/OFF of the engine start switch 1 is controlled. When the engine start switch 1 is turned on, the LEDs 61 and 62 mounted on the substrate 6 emit light. The light emitted from the LEDs 61 and 62 passes through the translucent rubber contact 7 and illuminates the operation surface 21 of the operation member 2 from the inside of the case 3.

The light plate 10 provided on the front side of the LED 62 is made of a translucent material so as to have a long shape extending in an axial direction of the case 3, and is disposed in the space formed above the slider 8. The light plate 10 forms a part of the light path of the LED 62, and transmits light to a predetermined point of the operation surface 21. The coil antenna 65 has a structure in which a coil (not shown) is wound on a ring-shaped holding member. Processing for authenticating a unique ID of a vehicle is performed between the vehicle and a vehicle key by the coil antenna 65, so that the unauthorized operation of the engine start switch 1 is prevented.

In the engine start switch 1 including this structure, the operation member 2 and the slider 8 slide rearward as a single body when the operation surface 21 of the operation member 2 is pressed at the time of the starting of the engine. Further, the pressing portion 81 of the slider 8 presses the dome portions 71 of the rubber contact 7 and the movable contacts provided on the backs of the dome portions 71 come into contact with the stationary contacts 63 provided on the substrate 6. Accordingly, the engine start switch 1 is turned on and the LEDs 61 and 62 emit light.

The light emitted from the LED 61 passes through the translucent rubber contact 7, and illuminates the center point of the operation surface 21 through the hole 82 of the pressing portion 81. Furthermore, the light emitted from the LED 62 passes through the translucent rubber contact 7, and illuminates a predetermined point of the operation surface 21 through the light plate 10. Moreover, the engine start switch 1 according to this embodiment is provided with the waterproof structure that prevents the infiltration of water droplets into the substrate 6 as described above.

Figure 3:
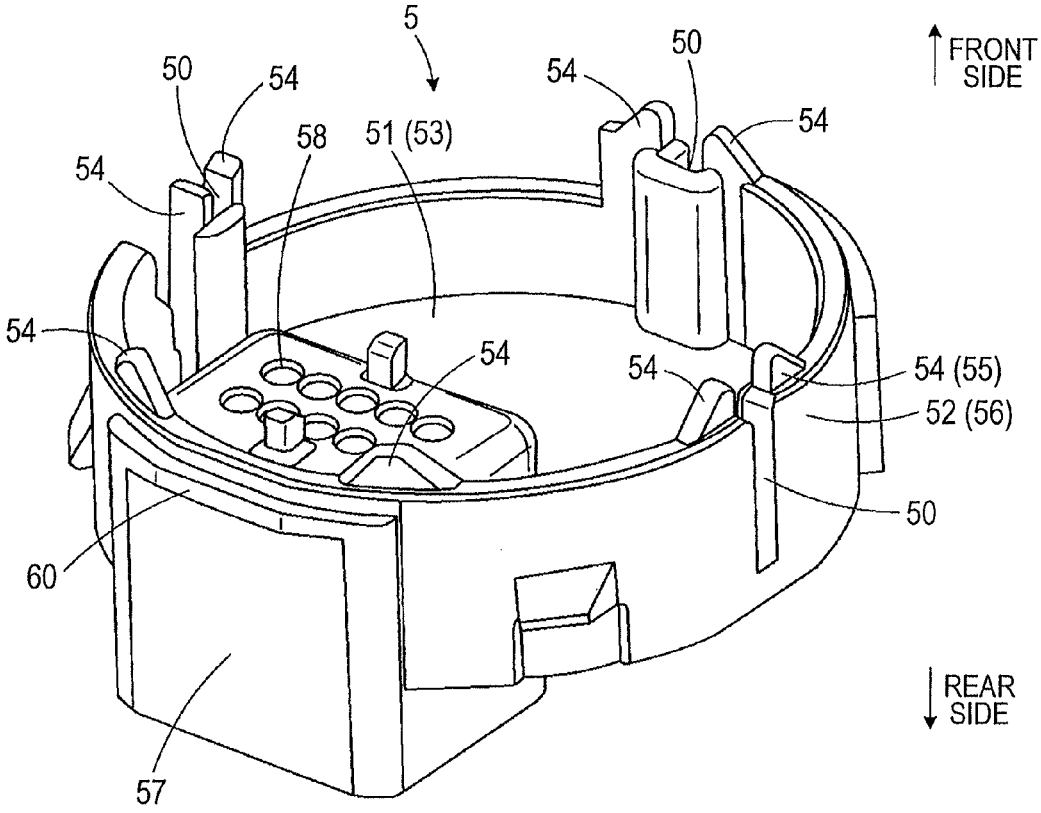
FIG. 3 is a perspective view of a rear cover of this embodiment.
Figure 4C:
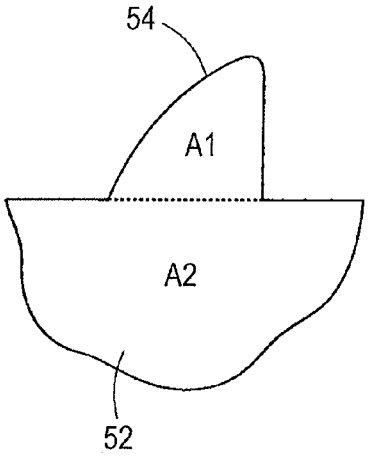

The waterproof structure for the engine start switch according to this embodiment will be described in detail below with reference to FIGS. 3 and 4. FIG. 3 is a perspective view of the rear cover of this embodiment. FIGS. 4A to 4D are views used to illustrate the waterproof structure according to this embodiment. FIG. 4A is a view illustrating a waterproof structure according to Comparative example, and FIG. 4B is a view illustrating the waterproof structure according to this embodiment. Further, FIG. 4C is a view illustrating the change of the area of the rear cover facing the case of this embodiment.

As shown in FIG. 3, the rear cover 5 includes the bottomed cylindrical support main body 53 in which the peripheral wall portion 52 stands up from the bottom wall 51. Five protrusions 54, which protrude from the front end of the peripheral wall portion 52, are formed on the rear cover 5 with a gap interposed therebetween in a circumferential direction. Each of the protrusions 54 is formed in a substantially mountain shape so that the width of each protrusion is reduced toward the tip of each protrusion. Further, each of three protrusions 54 of the five protrusions 54 is divided into two pieces by each of guide grooves 50 that are formed in the peripheral wall portion 52. The guide grooves 50 are engaged with guide portions (not shown) of the case 3 at the time of the assembly of the rear cover 5. Furthermore, since the thickness of the protrusion 54 is smaller than the thickness of the peripheral wall portion 52, a difference in level is formed between an outer surface 55 of the protrusion 54 and an outer surface 56 of the peripheral wall portion 52.

Incidentally, there is a case in which water droplets are generated around the engine start switch 1 due to dew condensation or the like according to the operating environment of the engine start switch 1. As described above, a gap is formed between the inner surface of the case 3 and the outer surface of the rear cover 5 in the engine start switch 1. For this reason, when water droplets adhere to the rear end of the engine start switch 1, there is a concern that the water droplets infiltrate into the case 3 from the gap between the case 3 and the rear cover 5 due to capillary phenomenon.

In this case, since a uniform gap is formed between an inner surface 34 of an outer peripheral wall portion 31 of a case 3 and an outer surface 56 of a peripheral wall portion 52 of a rear cover 5 in the comparative example shown in FIG. 4A, water droplets 11 infiltrating from this gap are sucked into the case 3 due to capillary phenomenon. As a result, there is a concern that the water droplets 11 reach the surface of a substrate 6 and electronic components mounted on the surface of the substrate 6 are corroded.

In contrast, since the thickness of the protrusion 54 is smaller than the thickness of the peripheral wall portion 52 in this embodiment shown in FIG. 4B, a difference in levels is created between the outer surface 55 of the protrusion 54 and the outer surface 56 of the peripheral wall portion 52. For this reason, a gap C2 between the inner surface 34 of the outer peripheral wall portion 31 and the outer surface 55 of the protrusion 54 is wider than a gap C1 between the inner surface 34 of the outer peripheral wall portion 31 and the outer surface 56 of the peripheral wall portion 52. When water droplets 11 infiltrate into the gap C1 between the inner surface 34 of the outer peripheral wall portion 31 and the outer surface 56 of the peripheral wall portion 52, the water droplets 11 are sucked to the front of the substrate 6. Since the gap C2 between the inner surface 34 of the outer peripheral wall portion 31 and the outer surface 55 of the protrusion 54 becomes wider in front of the substrate 6, a suction force for water droplets becomes weak. Accordingly, the movement of water droplets 11 toward the substrate 6 is effectively suppressed.

In addition, since the protrusion 54 is formed in a substantially mountain shape so that the width of the protrusion is reduced toward the substrate 6 as shown in FIG. 4C, the area of the rear cover 5 facing the inner surface 34 of the outer peripheral wall portion 31 of the case 3 is larger at the peripheral wall portion 52 than at the protrusion 54. For this reason, a difference between the area A1 of the protrusion 54 facing the inner surface 34 of the case 3 and the area A2 of the peripheral wall portion 52 facing the inner surface 34 of the case 3 is suddenly changed at a boundary between the protrusion 54 and the peripheral wall portion 52. In general when water droplets move to an open space from a narrow closed space, the water droplets do not easily move to the open space since a force for holding the water droplets in the narrow closed space is large. For this reason, the water droplets 11 do not easily move to the protrusions 54 from the peripheral wall portion 52, so that the movement of water droplets toward the substrate 6 is more effectively suppressed.

Figure 4D:
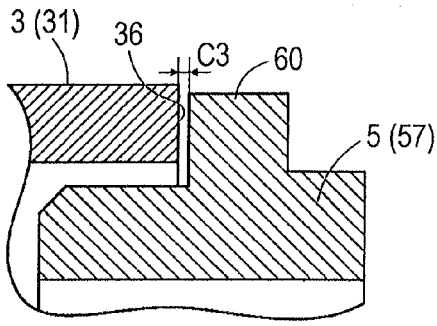

Further, as shown in FIG. 4D, the socket portion 57 of the rear cover 5 is provided with a waterproof wall 60 that faces a rear end face 36 of the outer peripheral wall portion 31 of the case 3. A small gap C3, which is smaller than the gap C1 between the inner surface 34 of the outer peripheral wall portion 31 and the outer surface 56 of the peripheral wall portion 52, is formed between the rear end face 36 of the outer peripheral wall portion 31 and the waterproof wall 60. The small gap C3 is formed to have a size that do not allow water droplets to infiltrate into the case 3 even though relatively large-sized water droplets adhere to the outer surface of the socket portion 57. The gap C3 is formed as small as possible for waterproofing at a point that is not associated with the assembly fitting, and the gap C1 considering assemblability is secured at a point that is associated with the assembly fitting.

Figure 5:
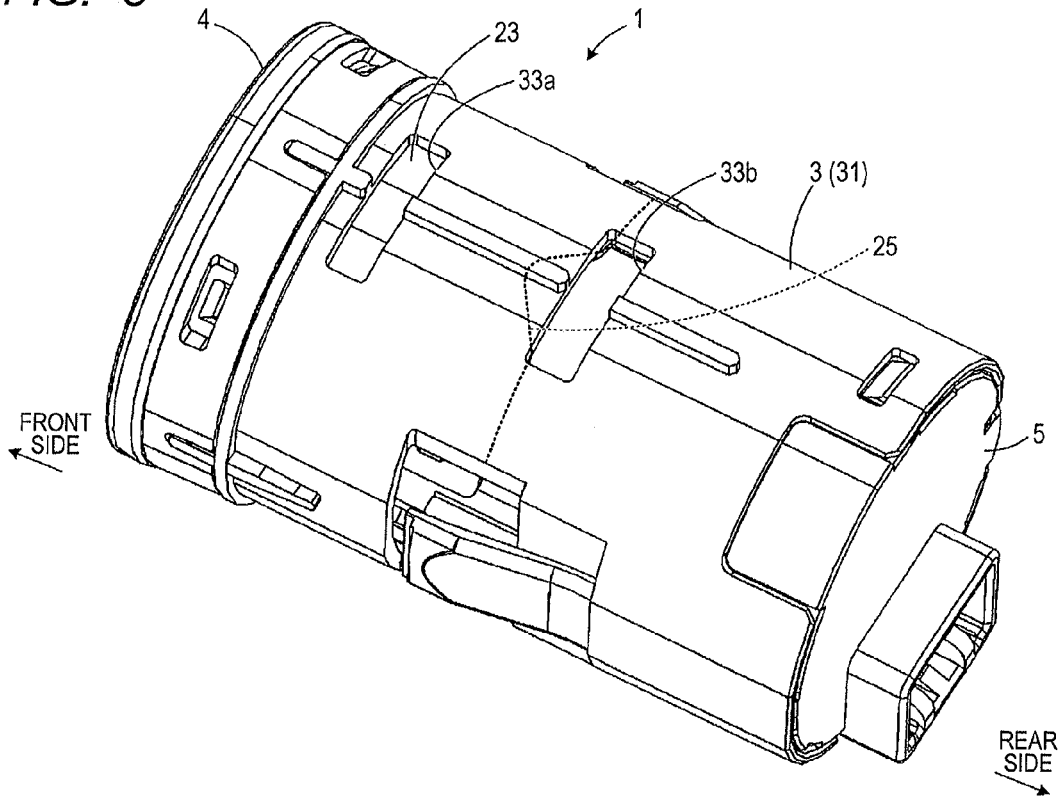
FIG. 5 is a perspective view of a drain structure of the engine start switch according to this embodiment.
Figure 6A:
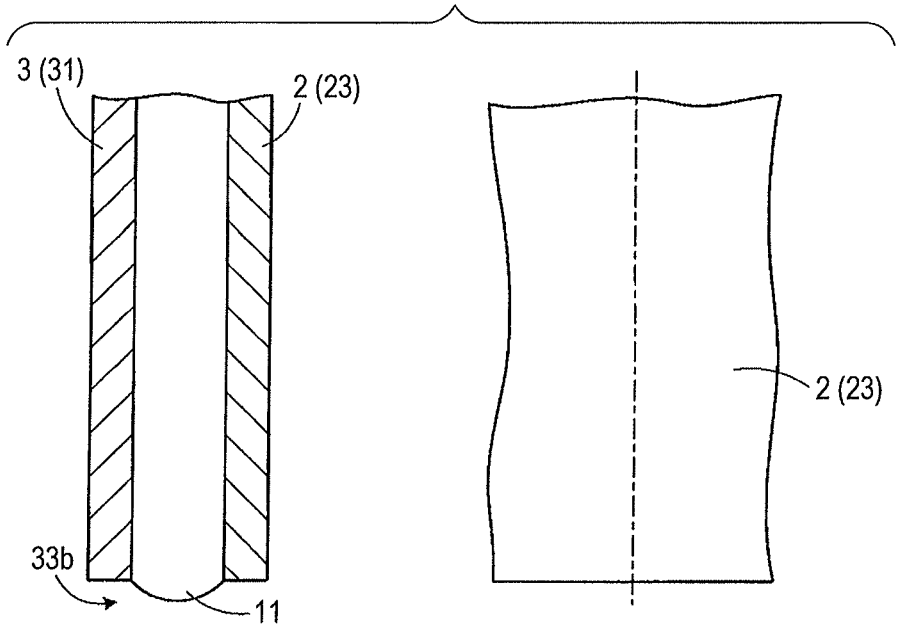
FIGS. 6A and 6B are views used to illustrate the drain structure of the engine start switch according to this embodiment.
Figure 6B:
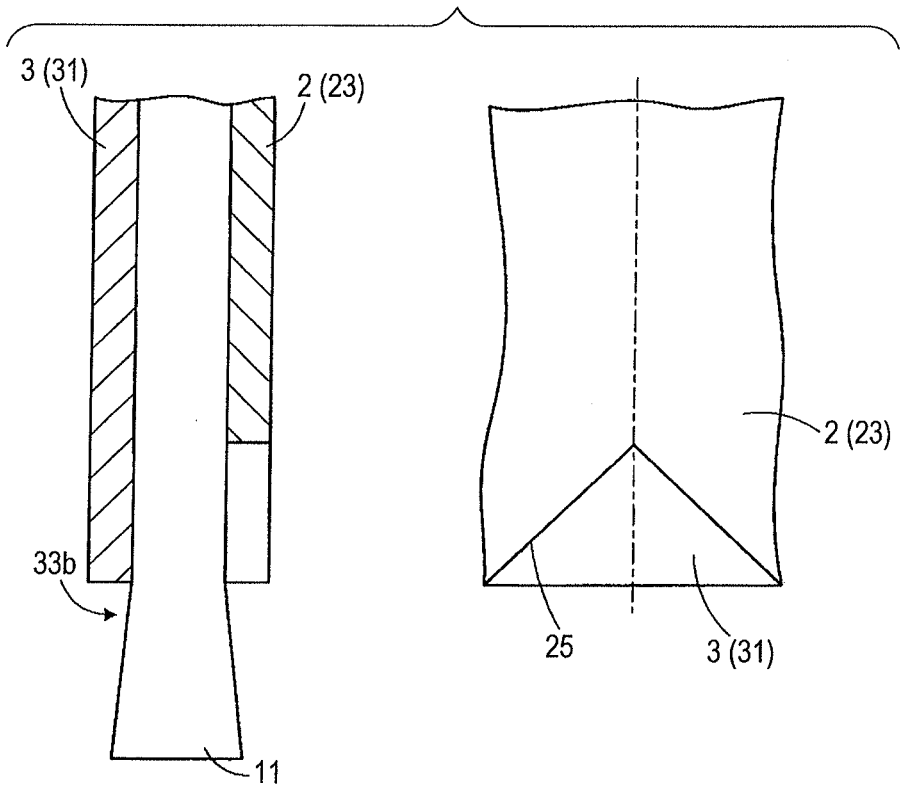

Next, a drain structure of the engine start switch according to this embodiment will be described in detail with reference to FIGS. 5 and 6. FIG. 5 is a perspective view of a drain structure of the engine start switch according to this embodiment. FIGS. 6A and 6B are views used to illustrate the drain structure of the engine start switch according to this embodiment. Meanwhile, FIG. 6A is a view illustrating a drain structure of a comparative example, and FIG. 6B is a view illustrating a drain structure of this embodiment.

As shown in FIG. 5, the engine start switch 1 is provided with the pair of drain ports 33*a* and 33*b* that are formed in the outer peripheral wall portion 31 of the case 3. Further, the notch 25 is formed at the cylindrical portion 23 of the operation member 2, which faces the outer peripheral wall portion 31 of the case 3, near the drain port 33*b* of the case 3. The notch 25 is notched in a substantially mountain shape so that the width of the notch 25 is increased toward the drain port 33*b* of the case 3. For this reason, the area of the cylindrical portion 23 of the operation member 2 facing the outer peripheral wall portion 31 of the case 3 is gradually reduced toward the drain port 33*b* of the case 3.

When water droplets move to an open space from a narrow closed space as described above, the water droplets do not easily move to the open space since a force for holding the water droplets in the narrow closed space is large. In this case, in the comparative example shown in FIG. 6A, the area of the cylindrical portion 23 of the operation member 2 facing the outer peripheral wall portion 31 of the case 3 is constant toward the drain port 33*b*. A space between the outer peripheral wall portion 31 of the case 3 and the cylindrical portion 23 of the operation member 2 is immediately changed to an open space from a narrow closed space at the open end of the drain port 33*b*. For this reason, a force for holding the water droplets 11 is increased between the outer peripheral wall portion 31 of the case 3 and the cylindrical portion 23 of the operation member 2, so that the water droplets 11 are not appropriately drained from the drain port 33*b*. The water droplets 11 are collected between the outer peripheral wall portion 31 of the case 3 and the cylindrical portion 23 of the operation member 2. In particular, if the water droplets 11 have viscosity like a soft drink or the like, the collected water droplets are dried as is and makes the case 3 and the operation member 2 adhere to each other. For this reason, there is a concern that the appropriate operation of the switch is hindered.

In contrast, in this embodiment shown in FIG. 6B, the notch 25 is formed at the cylindrical portion 23 of the operation member 2 so that the area of the cylindrical portion 23 of the operation member 2 facing the outer peripheral wall portion 31 of the case 3 is gradually reduced. The space between the outer peripheral wall portion 31 of the case 3 and the cylindrical portion 23 of the operation member 2 is gradually changed to an open space from a narrow closed space toward the drain port 33*b*. For this reason, a force for holding the water droplets 11 is reduced between the outer peripheral wall portion 31 of the case 3 and the cylindrical portion 23 of the operation member 2, so that the water droplets 11 are appropriately drained from the drain port 33*b*. Since the water droplets 11 between the case 3 and the operation member 2 are appropriately drained from the drain port 33*b* as described above, the adhesion between the case 3 and the operation member 2 is prevented.

According to the engine start switch 1 of this embodiment, as described above, the gap C2 between the inner surface 34 of the outer peripheral wall portion 31 of the case 3 and the outer surface 55 of the protrusion 54 of the rear cover 5 is wider than the gap C1 between the inner surface 34 of the outer peripheral wall portion 31 of the case 3 and the outer surface 56 of the peripheral wall portion 52 of the rear cover 5. For this reason, even though water droplets infiltrate into the gap C1 between the inner surface 34 of the outer peripheral wall portion 31 of the case 3 and the outer surface 56 of the peripheral wall portion 52 of the rear cover 5 due to capillary phenomenon, a suction force for the water droplets, which is caused by capillary phenomenon, is weakened at the protrusions 54 of the rear cover 5 that support the substrate 6. Accordingly, it is possible to prevent the water droplets from moving to the substrate 6, so that electronic components mounted on the substrate 6 are not corroded.

Meanwhile, the invention may have various modifications without being limited to the above-mentioned embodiment. The size, shape, and the like of each of members shown in the accompanying drawings are not limited to the above-mentioned embodiment, and may be appropriately modified as long as the effect of the invention is exhibited. The invention may be appropriately modified without departing from the scope of the invention.

For example, in the above-mentioned embodiment, it is preferable that the gap between the inner surface 34 of the outer peripheral wall portion 31 of the case 3 and the outer surface 55 of the protrusion 54 of the rear cover 5 be in the range of 0.55 mm to 0.75 mm. Accordingly, it is possible to more effectively prevent the movement of water droplets that is caused by capillary phenomenon. Further, it is preferable that the gap between the inner surface 34 of the outer peripheral wall portion 31 of the case 3 and the outer surface 56 of the peripheral wall portion 52 of the rear cover 5 be in the range of 0.15 mm to 0.35 mm. Accordingly, it is possible to appropriately fit the rear cover 5 to the case 3 while improving the assemblability of the case 3 and the rear cover 5.

Furthermore, the coil antenna 65 has been disposed around the operation member 2 in the above-mentioned embodiment, but the invention is not limited thereto. The coil antenna 65 may be mounted on the center of the back of the substrate 6. In this case, since the coil antenna 65 is disposed on the center of the back of the substrate 6, the light emitted from the LEDs 61 and 62 is not blocked by the coil antenna 65 even though the coil antenna 65 is not formed in a ring shape. Accordingly, the degree of freedom in the disposition of the LEDs 61 and 62 is improved. Further, it is possible to improve the decoration of the engine start switch 1.

Moreover, the substrate 6 has been supported at a plurality of points by the plurality of protrusions 54 in the above-mentioned embodiment, but the invention is not limited thereto. The entire circumference of the substrate 6 may be supported by the rear cover 5.

Further, the waterproof structure has been applied to the engine start switch 1 in the above-mentioned embodiment, but the invention is not limited thereto. The waterproof structure may be applied to any device that receives electronic components in a case 3.

Furthermore, the protrusion 54 has been formed so that the width of the protrusion is reduced toward the tip of the protrusion in the above-mentioned embodiment, but the invention is not limited thereto. As long as the area of the outer surface 55 of the protrusion 54 facing the inner surface 34 of the outer peripheral wall portion 31 of the case 3 is gradually reduced, the protrusion 54 may be formed in any shape.

Further, the area of the outer surface 55 of the protrusion 54 of the rear cover 5 facing the inner surface 34 of the outer peripheral wall portion 31 of the case 3 has been gradually reduced in the above-mentioned embodiment, but the invention is not limited thereto. If the gap between the inner surface 34 of the outer peripheral wall portion 31 of the case 3 and the outer surface 55 of the protrusion 54 of the rear cover 5 is wider at other portions excluding at least one end portion of the rear cover 5 than at least the one end portion of the rear cover 5, the area of the outer surface 55 of the protrusion 54 of the rear cover 5 facing the inner surface 34 of the outer peripheral wall portion 31 of the case 3 may not be reduced.

Furthermore, the rear cover 5 has included the cylindrical peripheral wall portion 52 in the above-mentioned embodiment, but the invention is not limited thereto. The rear cover 5 only has to include an outer surface facing the inner surface 34 of the outer peripheral wall portion 31 of the case 3, and may be formed, for example, in a columnar shape.

Moreover, the outer peripheral wall portion 31 of the case 3 has a cylindrical shape in the above-mentioned embodiment, but the invention is not limited thereto. The outer peripheral wall portion 31 of the case 3 may be formed in the shape of a cylinder having a polygonal cross-section.

As described above, the invention has an effect of preventing water droplets from infiltrating into a case by a simple and inexpensive structure, and is particularly useful for a waterproof structure, which can be applied to an engine start switch, and a switch device.

It should be understood by those skilled in the art that various modifications, combinations, sub-combinations and alterations may occur depending on design requirements and other factors insofar as they are within the scope of the appended claims of the equivalents thereof.

What is claimed is:

1. A waterproof structure comprising:

a substrate on which electronic components are mounted;

a case which is formed in a cylindrical shape by a peripheral wall portion surrounding the substrate and of which at least one end portion is opened; and a support member that supports the substrate in the case and extends toward the open end of the case from one end portion thereof supporting the substrate, wherein the support member includes a support main body that faces the peripheral wall portion over the entire circumference at the other portions except for the one end portion, and a plurality of protrusions that partially face the peripheral wall portion at the one end portion, wherein the support member includes an outer surface that faces an inner surface of the peripheral wall portion with a gap interposed therebetween, and a gap at the one end portion of the support member is wider than a gap at other portions excluding at least the one end of the support member, and a plurality of points of the substrate are supported by the plurality of protrusions, wherein the plurality of protrusions are formed thin so that a gap between the inner surface of the peripheral wall portion and an outer surface of each of the plurality of protrusions is wider than a gap between the inner surface of the peripheral wall portion and the outer surface of the support main body.

2. The waterproof structure according to claim 1, wherein the gap between the inner surface of the peripheral wall portion and the outer surface of each of the plurality of protrusions is in the range of 0.55 mm to 0.75 mm, and the gap between the inner surface of the peripheral wall portion and the outer surface of the support main body is in the range of 0.15 mm to 0.35 mm.

3. A switch device including the waterproof structure according to claim 1.

* * * * *